US007708170B2

(12) United States Patent
Kelly et al.

(10) Patent No.: US 7,708,170 B2
(45) Date of Patent: May 4, 2010

(54) RETAINER FOR SLEEVE FOR RECHARGING A CLEANING, SANITIZING OR DISINFECTANT FLUID SPRAY SYSTEM

(76) Inventors: Albert R. Kelly, 226 E. 54$^{th}$St., New York, NY (US) 10022; George Schmidt, 226 E. 54$^{th}$St., New York, NY (US) 10022

( * ) Notice: Subject to any disclaimer, the term of this patent is extended or adjusted under 35 U.S.C. 154(b) by 0 days.

(21) Appl. No.: 12/214,516

(22) Filed: Jun. 20, 2008

(65) Prior Publication Data

US 2009/0071987 A1 Mar. 19, 2009

Related U.S. Application Data

(63) Continuation-in-part of application No. 10/934,960, filed on Sep. 7, 2004, now abandoned.

(51) Int. Cl.
*B67D 7/58* (2010.01)

(52) U.S. Cl. ..... 222/382; 222/383.1; 222/464.2; 15/104.93

(58) Field of Classification Search ..... 222/382, 222/383.1, 464.1, 464.2; 239/333; 15/104.93
See application file for complete search history.

(56) References Cited

U.S. PATENT DOCUMENTS 4,418,846 A * 12/1983 Pong et al. ..... 222/189.1
4,530,450 A * 7/1985 Nandagiri ..... 222/402.1
5,529,216 A * 6/1996 Klima et al. ..... 222/130
5,947,332 A * 9/1999 Klima et al. ..... 222/82
6,250,511 B1 * 6/2001 Kelly ..... 222/382

* cited by examiner

*Primary Examiner*—Frederick C. Nicolas
(74) *Attorney, Agent, or Firm*—Evelyn M. Sommer

(57) ABSTRACT

A recharge sleeve for use with a spray dispenser device, made of a matrix comprises an absorptive material impregnated with a chemical composition that dissolves in solution created when the sleeve is contacted with a diluent fluid such as water. The recharge sleeve is elongated in shape with a center opening parallel to the long edges of the sleeve for mounting on the diptube of the spray dispenser device. A conically shaped retainer formed of rigid plastic is attached or provided for attachment to the lower end of the diptube for stabilizing the diptube and retaining the recharge sleeve clear of the bottom of the retainer after the sleeve has been applied to the diptube. When of the spray dispenser device is sealed and the spray dispenser device is shaken, the fluid penetrates into the matrix material, and the chemical composition dissolves in the fluid creating a cleaning, sanitizing, or disinfectant solution that will remain stable and fully active in use.

7 Claims, 4 Drawing Sheets

RETAINER FOR SLEEVE FOR RECHARGING A CLEANING, SANITIZING OR DISINFECTANT FLUID SPRAY SYSTEM

RELATED APPLICATION

This application is a continuation in part of U.S. application Ser. No. 10/934,960 entitled Sleeve For Recharging A Cleaning, Sanitizing Or Disinfectant Fluid Spray System filed Sep. 7, 2004 now abandoned.

FIELD OF THE INVENTION

This invention generally relates to spray bottle systems for dispensing cleaning, sanitizing or disinfectant fluids, and more particularly, to a recharge sleeve for placement over the diptube provided with a position-fixing retainer mounted on the bottom-most portion of the diptube for holding the sleeve clear of the lower intake end of the diptube and for facilitating the extraction of the sleeve from the spray bottle after use, the retainer also being adapted for facilitating the manual insertion of the diptube/retainer structure into the sleeve without requiring the user to touch the sleeve by hand.

BACKGROUND OF THE INVENTION

Due to regulations curtailing the use of aerosol dispensers for chemical reagents that discharge foaming or pressurized gases or hydrocarbons into the atmosphere, the use of spray bottles that are manually pumped has become widespread. The typical spray bottle dispenser consists of a plastic container holding fluid with chemical reagent dissolved therein, which is sealed by a threaded cap mounting a sprayhead from which a diptube projects and extends downwardly into the body of the container. When the user operates a trigger on the sprayhead, the contents of the diptube are pumped up into the sprayhead and sprayed out from a directional orifice or nozzle.

Many vendors sell separately bottles of fluid for refilling the spray dispenser bottle, or for transferring the sprayhead thereto when the contents of the first-purchased dispenser bottle are used up, so that the sprayhead and bottle can be reused. Often, the refill bottles contain a large volume of fluid so that the original dispenser bottle can be refilled several times before another refill bottle needs to be purchased.

This widely used type of spray dispenser system has associated therewith several problems which the present invention seeks to eliminate. One problem is that the refill bottles take up a large volume which incurs additional shipping costs, storage costs, and demand for shelf space. Another problem is that a refill bottle must be sold for the specific types of fluid it is intended as a refill. Thus, if a vendor sells different formulations of the same cleaner (ordinary cleaning, high strength) or different types of cleaners under the same product name (lemon-scented, disinfecting, kitchen/bath tile cleaner), then a refill bottle must be sold for each grade and type of fluid.

A further problem is that pouring fluid from the refill bottle can incur spills or require potentially hazardous handling of caustic or toxic fluids. On the other hand, if the fluids must be made in very dilute concentrations for public safety in handling, then the cleaning ability or effectiveness of the product may be compromised. The refill bottles themselves are discarded after use, thus adding to plastic pollution and landfill waste.

There have been various proposals for providing a rechargeable insert holding chemical in concentrated form which can be used with a spray dispenser system. For example, U.S. Pat. Nos. 3,655,096, 3,966,089, 4,088,246, and 5,421,483 show a capsule or cartridge holding concentrated material which is secured in the neck of the bottle and released by threading the sealing cap or a ring nut against it to puncture its bottom walls against a sharp element or to squeeze the concentrate out. These types of puncturable or burstable cartridge systems are costly to fabricate, complicated to operate, and potentially hazardous if a problem occurs and the user must open the container and reposition or remove a failed cartridge.

U.S. Pat. No. 5,529,216 shows another rechargeable spray dispenser system in which an elongated insert having one or more concentrate-containing compartments is inserted in the bottle, and a sharp end of the diptube is used to puncture through upper and/or lower sealing membranes in order to release the concentrate into the diluent fluid (water) filled into the bottle. However, this type of recharge insert must be purchased with a sharp diptube, and cannot be used with an existing or currently marketed spray dispenser bottle that has a blunt diptube. Moreover, the sealing walls must be punctured by the user manipulating the diptube while the container is open, thereby presenting a risk that concentrate will be ejected under the pressure applied to the sealing walls back at the user.

U.S. Pat. No. 6,540,109 discloses a rechargeable spray bottle dispenser including at least one chemical reservoir received within the bottle. The reservoirs contain concentrated chemicals and can be released into the bottle by bursting, puncturing or other suitable means. This type of design requires the modification of the spray bottles at the point of manufacture and cannot be used economically on the conventional spray bottles.

U.S. Pat. No. 6,250,511 shows dry-to-the touch elongated rechargeable inserts, which contain chemicals that can be dissolved in water for cleaning purposes. The inserts are applied to the outside of the diptube in a spray bottle and the insert is prevented from blocking the intake end (lower end) of the diptube by employing one of the following designs: tight fitting between the diptube and the insert, the use of lower spacer legs, the use of an upper retaining disk, or wrapping the slotted insert around the diptube.

SUMMARY OF THE INVENTION

In the present invention, there is presented a recharge sleeve, for use with a spray dispenser device having a container body, a sprayhead mounted with a sealing cap, and an elongated diptube which is inserted into the container body during use, and a retainer applied to the lower (intake) end of the diptube to prevent the sleeve from blocking the lower end of the diptube and to facilitate the extraction of the sleeve from the spray bottle after use, the retainer being adapted to facilitate the insertion of the diptube/retainer structure into the sleeve without the users having to touch the sleeve by hand. The distal or bottommost end of the retainer tapers inwardly for these purposes. The sleeve is comprised of adsorptive material, of one or multiple layers with at least one of the layers being an absorptive material. The absorptive material or the at least one layer thereof in the latter case is impregnated with a non-aqueous chemical composition which will dissolve when contacted with a diluent fluid such as water. The recharge sleeve is formed in an elongated rectangular shape with a center opening for mounting on the diptube. The sleeve material has an outer surface which is porous to fluid filled into the container body so that the fluid can penetrate into the sleeve material and dissolve the chemical composition which has been impregnated therein. A substantially rigid retainer is attached or provided for attachment to the lower end of the diptube for the following benefits. The retainer is used to stabilize the diptube and to keep the sleeve from blocking the intake end of the diptube and impeding or blocking the liquid flow into the diptube during use. The retainer also functions to facilitate the insertion of the diptube into the sleeve and also to facilitate the extraction of the spent sleeve from the spray bottle after use by preventing the wet, heavier and flimsy sleeve from falling off the diptube. The retainer is tapered inwardly at its distal end, i.e., the end on the opposite side of its attachment to the diptube and thereby allows the diptube and the retainer to be slipped easily into the recharge sleeve before use when the sleeve is still in its retail package, so that the treated sleeve can be extracted from the package without having to be touched by the user's hand. Most preferably, the retainer is attached to the lower end of the diptube during manufacture of the diptube. Alternatively, the retainer can be attached either before or after the sleeve is applied to the diptube by the end user.

In a preferred embodiment, the sleeve material is a multiple layered synthetic, binder-free, nonwoven substrate enclosing an opening along its center axis for inserting the diptube there through. The multiple layers are bonded together without a chemical binder, such as by heat bonding, ultrasonic bonding, stitching, or mechanical or hydraulic entanglement, or are constituted of an open-celled foam material. The cleaning, sanitizing or disinfectant chemical composition is impregnated into the adsorptive material or a layer thereof by coating or spraying the adsorptive material or layer with a treatment solution. The sleeve material has a desired porosity, in order to allow fluid to penetrate through the material and dissolve the chemical composition impregnated therein. The retainer, which is substantially rigid, is preferably made of a polymeric material or a blend thereof, such as polyester or polypropylene and is, preferably, conical in shape. The upper end of the retainer possesses a square-cut shoulder and an inside diameter that can receive the lower (intake) end of the diptube and allow for attachment to the diptube. The inside diameter of the retainer tapers from the upper end of the retainer to the lower end of the retainer so as to accommodate different sized diptubes. The maximum effective outside diameter of the retainer (either that of the retainer's main body or other protruding structures such as ridges) is small enough to allow the unused sleeve to be applied to the diptube without using excessive force and rupturing the sleeve, and yet it is large enough to hold the sleeve in its position and prevent it from slipping downwardly over the diptube during use, so that the sleeve does not block the intake of the diptube during use and for facilitating the spent sleeve being easily extracted from the diptube after use. The square-cut shoulder further helps in retaining the sleeve onto the diptube. The lower end of the retainer has an outside diameter that is significantly smaller than the diameter of the sleeve opening, so that the diptube and the retainer can be easily inserted into the sleeve without requiring the user to touch the sleeve by hand, thereby eliminating the undesired contact between the user's skin and the unused treated sleeve containing highly concentrated and potentially skin sensitizing or irritating treatment compositions. The retainer also possesses at least one side opening at its lower end that allows fluid to flow unobstructed in the event that the lower end of the retainer is in contact with the bottom of the bottle.

When the spray bottle, with the retainer attached and the sleeve applied, is filled with water, sealed, and shaken, the chemical composition becomes dissolved in the water, thereby creating a cleaning, sanitizing or disinfectant solution that will remain stable and fully active.

The objects, features, and advantages of the present invention will be explained in the following detailed description of the invention having reference to the appended drawings.

DETAILED DESCRIPTION OF THE INVENTION

Figure 1:
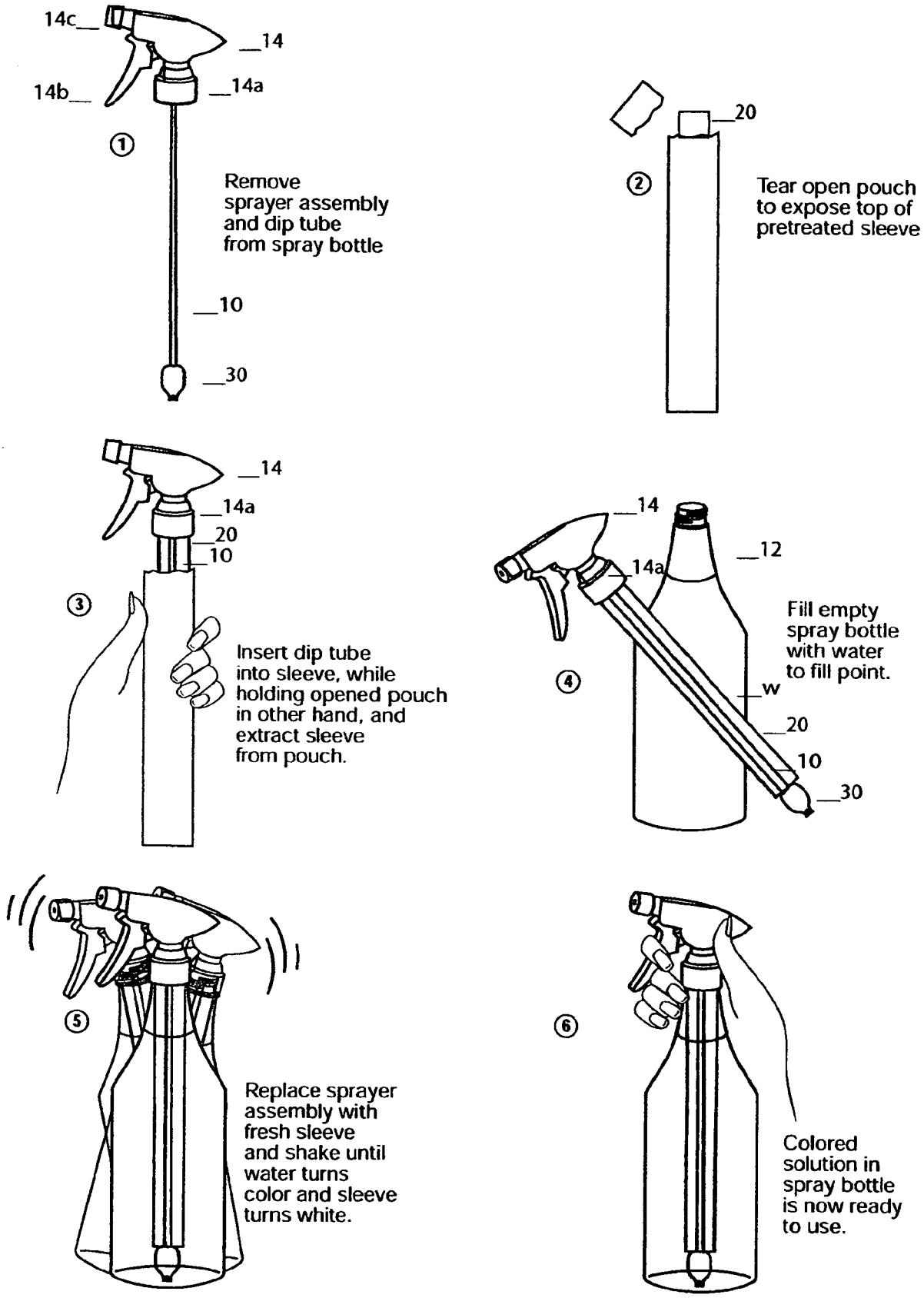
FIG. 1 illustrates a preferred embodiment of a recharge sleeve in accordance with the invention, and the steps for using it.

Referring to FIG. 1, a preferred embodiment of a recharge sleeve 20 in accordance with the present invention is illustrated for use with a standard spray dispenser device having a container body 12 for holding fluid, a sprayhead 14 mounted with a sealing cap 14*a*, spray trigger 14*b*, and spray orifice or nozzle 14*c*, an elongated diptube 10 which is inserted into the body of the container 12 during use, and a retainer 30 attached to the lower end of the diptube during manufacture of the diptube. The recharge sleeve 20 is comprised of an absorbent matrix material with one or multiple layers wherein at least one layer is impregnated with a chemical composition, leaving the sleeve dry-to-the-touch, the chemical composition becoming dissolved in solution with a diluent fluid such as commonly available tap water.

The recharge sleeve 20 is shaped as a rectangular elongated sleeve by adding or combining at least two layers of water insoluble fibrous material sealed along their elongated edges, and having an open channel parallel to the elongated edges with openings on the short edges. When the original contents of the spray bottle are used up, the sealing cap is removed (typically by unthreading) from the container body. In the preferred embodiment, the retainer 30 is attached to the intake end of the plastic diptube either during manufacture of the diptube or on site before the sleeve is mounted onto the diptube. The recharge sleeve is mounted by inserting it over the diptube 10 until the intake end of the diptube projects from the end of the sleeve 20 and the upper end of the retainer. The application/mounting of the sleeve can be achieved without the user touching the sleeve as shown in part 2 of FIG. 1. When the spray bottle is filled with water W, sealed with the sealing cap 14*a*, and shaken, the chemical composition impregnated in the absorptive material of the sleeve 20 becomes dissolved by the fluid to form a cleaning, sanitizing or disinfectant solution WS.

Obviously, alternative sequences of steps for recharging can be followed. For example, the sleeve can be mounted to the diptube before the retainer is attached at the lower end of the diptube.

Most preferably, the diptube, the sprayhead and the retainer that matches the diptube, are packaged and provided as a unit. The retainer is dimensioned to fit the diptubes with a particular outside diameter, but not any generic diptubes. In this case, the retainer can be optionally manufactured as an integral part of the diptube or fused with the lower end of the diptube.

The sleeve material and/or each layer thereof comprises a water insoluble, binder-free fibrous substrate. The layers are bonded together without a chemical binder, such as by ultrasonic bonding, stitching, or mechanical or hydraulic entanglement. For example, the layers can be made up of synthetic fibers processed into woven, knitted, or nonwoven forms, or synthetic fibers combined with natural fibers. The substrate can also be a flexible, open-celled foam material. Use of a chemical binder is avoided to prevent such chemicals from being dissolved by and leaching into the fluid, thereby contaminating or reducing the effectiveness of the cleaning, sanitizing or disinfectant solution. The nonwoven substrate can be fabricated and/or processed so that its outer surface has a desired porosity to allow fluid to readily penetrate into the adsorptive material and dissolve the chemical impregnated therein. The fluid penetration is significantly facilitated by the use of sonic bonding or needling in the manufacture of the sleeve material for joining multiple layers to form a unitary composite material. The sonic and needling process leaves pores in the material which allow efficient fluid flow. If there is more than one layer, the layers can be bonded together using any of the above-mentioned bonding methods. Needling clearly offers the added benefit of enhanced fluid flow efficiency. The layer or multiple layers can be made into the sleeve after sealing along the elongated edges using any of the means mentioned above.

Figure 2:
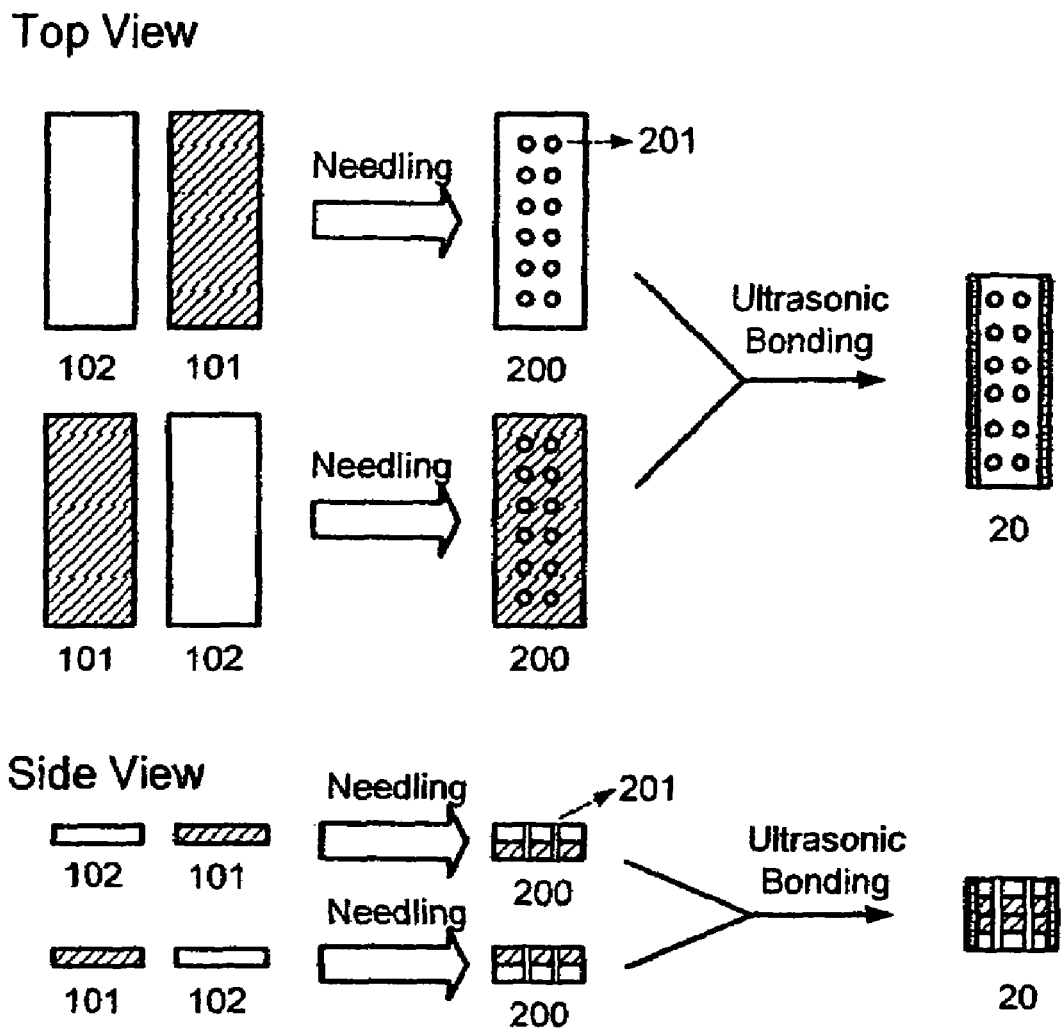
FIG. 2 illustrates a preferred embodiment of a recharge sleeve and the steps of making it.

In an embodiment of the sleeve, as shown in FIG. 2, two layers 200 of the fibrous material form the sleeve 20, and each layer is further divided to two layers 101 and 102. The layer facing outside 102 comprises non-woven synthetic material that provides enhanced structural integrity to minimize the damage to the sleeve during vigorous shaking. The layer facing inside 101 comprises non-woven synthetic material that is optimized to absorb large amount of cleaning composition. In an alternative mode of the preferred embodiment, each layer of the sleeve comprises three layers, the middle layer being the absorptive layer, and the outmost and innermost layers being structural mechanical stabilization layers. Each layer is needle punched (pores introduced by needling and shown as 201), as the bonding methods for layers comprising multiple layers, which further provides pores that facilitate the liquid flow across the layer(s). The two layers of fibrous material are preferably joined together to form the sleeve by ultra-sonically bonding them along the two elongated edges.

The desired cleaning, sanitizing or disinfectant chemical composition can be impregnated in the matrix material by any suitable means. For example, a simple chemical impregnation process is described in commonly owned U.S. Pat. No. 5,091,102 to Sheridan, which is incorporated in its entirety herein by reference. In the Sheridan process, the matrix substrate is coated with non aqueous treatment solution so that the resulting material is dry to the touch and has the desired amount of chemical composition impregnated therein so that it can be released by contact with water prior to use. The absorptive material is capable of absorbing a cleaning composition in an amount of up to at least six times of its basis weight. The treatment solution can comprise between about 25% and 75% of at least one glycol compound, between 0.2% and 60% of an antimicrobial component, between about 5% and 45% of a surfactant, and optionally effective amounts of fragrances, dyes and other additives.

Figure 3A:
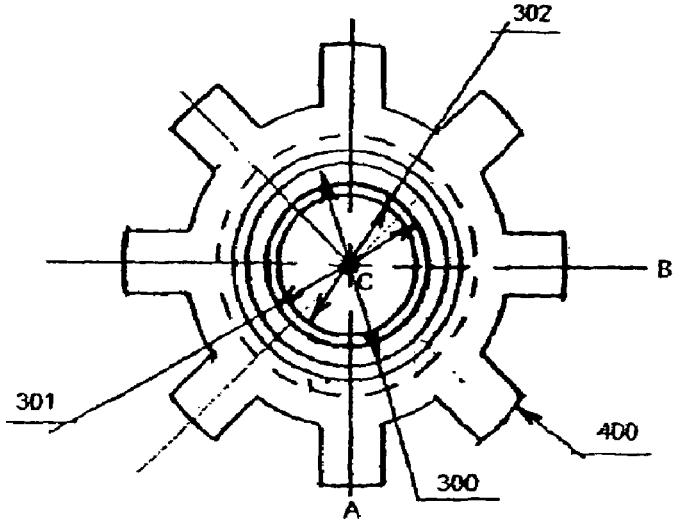
FIGS. 3A and 3B illustrate an embodiment of the retainer to be used in conjunction with the sleeve in accordance with the invention. 3A is a top view and 3B is a side view with the right side in 3B shown as a cross section along the A-C-B line in 3A.
Figure 3B:
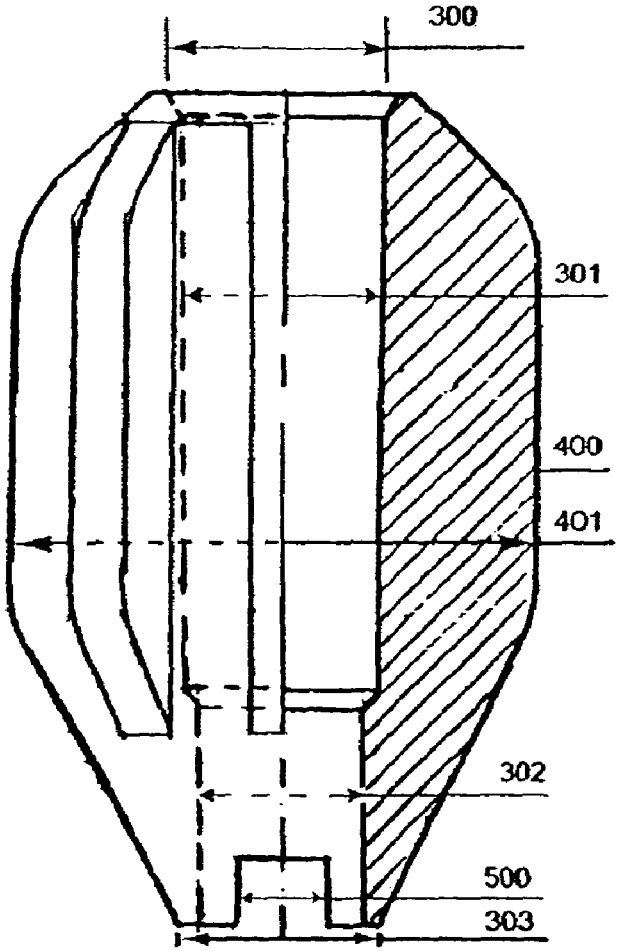

The preferred means of holding the sleeve in its position on the diptube and therefore stabilizing it and preventing it from blocking the intake end of the diptube during use or recharging, the latter typically involving vigorous shakings, and the preferred means of facilitating the extraction of spent sleeve from the spray bottle after use, are by the application of a retainer (30 in FIG. 1) onto the lower end of the diptube during manufacture of the diptube before the sleeve has been applied to the tube. Further, in one embodiment, the retainer possesses an inwardly tapered end to facilitate the insertion of the diptube and the retainer into the sleeve before use. One example of a retainer that can be used for this purpose is illustrated in FIG. 3*a* and FIG. 3*b*. The upper end of the retainer has an opening 300 larger than the outside diameter of the diptube, and an inside diameter 301 that can allow the retainer to tightly fit onto the lower end of the diptube. The lower end of the retainer has an inside diameter 302 that is smaller than the outside diameter of the diptube, and therefore does not allow the diptube to protrude out of the lower end of the retainer. The lower end of the retainer further has an outside diameter 303 that is significantly smaller than the diameter of the sleeve opening, allowing the diptube and the retainer to be easily inserted into the sleeve in the absence of direct finger contact with the treated sleeve by the users. Multiple ridges 400 are provided on the outside surface of the retainer in a radial manner to increase the maximum effective outside diameter 401 of the retainer structure. The retainer is attached to the lower end of the diptube before use, i.e., in manufacture as in the preferred embodiment, but can be separate and applied after the sleeve has been applied to the diptube. The combination of the diptube and the retainer in manufacture or the subsequent tight fitting attachment of the retainer to the diptube, and the enlarged effective diameter of the retainer through the introduction of the ridges can prevent the sleeve from slipping downwardly on the diptube and allow easy removal of the spent sleeves which tend to be heavier, wet and flimsy after use. The lower end of the retainer possesses at least one opening 500 to the side. The opening allows the solution to flow into the diptube as when the lower end of the retainer is in contact with the bottom of the spray bottle. Because diptubes employed in various commercial spray bottles may possess different outside diameters, in the case of the separate retainer and diptube multiple retainers would be necessary for typical daily recharging operations with each combination of the upper end and lower end inside diameters optimized for a diptube with a particular outside diameter. Preferably, in this case, instead of having two distinct inside diameters for the upper and lower ends, the retainer can possess a void with a conical shape, with the upper end opening larger than the lower end opening. Retainers designed in this manner have the potential of universally fitting diptubes with different outside diameters, provided that the upper end opening is large enough to accommodate the outside diameter of the thickest diptubes, and the lower end opening is smaller than the outside diameter of the narrowest diptubes. Another design of the retainer can have multiple inside diameters in the central void in a decreasing and stepwise order from the upper end opening to the lower end opening. Retainers designed in this manner also possess the capability of universally fitting diptubes with different outside diameters.

Figures 4A, 4B, 4C, 4D:
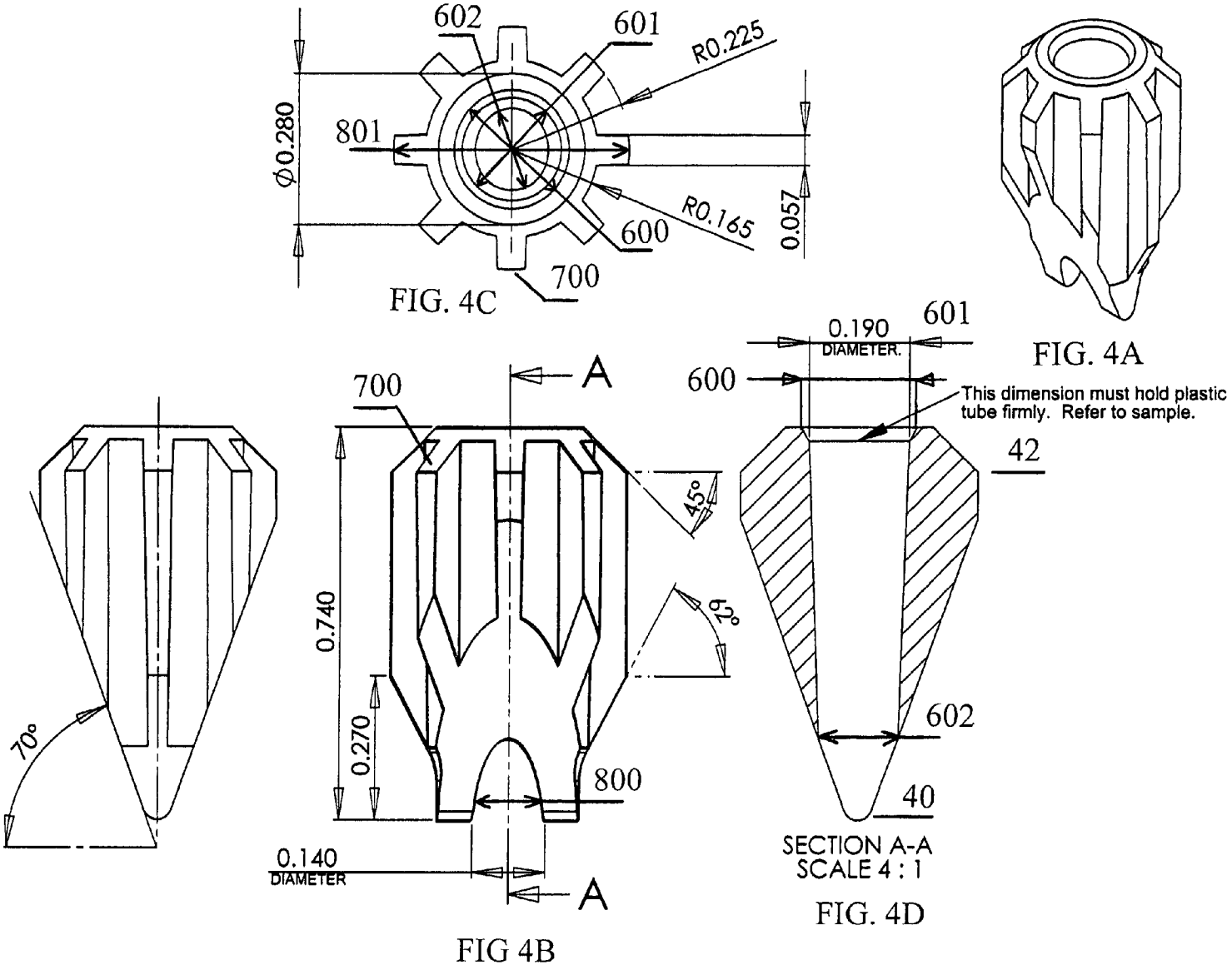
FIG. 4A depicts a three dimensional view of a preferred embodiment of the retainer to be used in conjunction with the sleeve in accordance with the invention.
FIG. 4B is a front view of the retainer depicted in FIG. 4A.
FIG. 4C is a top view of the retainer depicted in FIG. 4A.
FIG. 4D depicts a cross section along the A-A line in FIG. 4B.

FIG. 4A depicts a three dimensional view of a preferred embodiment of a retainer (30 in FIG. 1). FIG. 4D is a cross sectional view of FIG. 4B along line A-A. As depicted in FIG. 4D, the retainer is conically shaped having a point 40 to facilitate the insertion of the diptube and the retainer into the sleeve before use. The upper end of the retainer has an opening 600 larger than the outside diameter of the diptube, and an inside diameter 601 that can allow the retainer to fit snugly onto the lower end of the diptube.

The lower end of the retainer has an inside diameter 602 that is smaller than the outside diameter of the diptube, and therefore does not allow the diptube to protrude out of the lower end of the retainer. Because of the retainer's conical shape, the lower end of the retainer comes to a point 40, which is smaller than the diameter of the sleeve opening, thus allowing the diptube and the retainer to be easily inserted into the sleeve in the absence of direct finger contact with the treated sleeve by the users. Multiple ridges 700 are also provided on the outside surface of the retainer in a radial manner to increase the maximum effective outside diameter 801 of the retainer structure.

As in other embodiments of the retainer, the retainer is preferably attached to the lower end of the diptube before use, i.e., in manufacture as in the preferred embodiment, but can be separate and applied after the sleeve has been applied to the diptube. The combination of the diptube and the retainer in manufacture or the subsequent tight fitting attachment of the retainer to the diptube, the enlarged effective diameter of the retainer through the introduction of the ridges 700, and the square-cut shoulder 42 ensures that the retainer retains the sleeve onto the diptube and can prevent the sleeve from slipping downwardly on the diptube and allow easy removal of the spent sleeves which tend to be heavier, wet and flimsy after use.

The lower end of the retainer possesses at least one opening 800 to the side. The opening 800 allows the solution to flow into the diptube when the lower end of the retainer is in contact with the bottom of the spray bottle. Because diptubes employed in various commercial spray bottles may possess different outside diameters, in the case of the separate retainer and diptube multiple retainers would be necessary for typical daily recharging operations with each combination of the upper end and lower end inside diameters optimized for a diptube with a particular outside diameter. Instead of having two distinct inside diameters for the upper and lower ends, the retainer can possess a tapered void to accommodate different sized diptubes. Retainers designed in this manner have the potential of universally fitting diptubes with different outside diameters, provided that the upper end opening is large enough to accommodate the outside diameter of the thickest diptubes, and the lower end opening is smaller than the outside diameter of the narrowest diptubes.

The retainer whether integral with the diptube or not can be manufactured using various materials with appropriate mechanical strength, ease of manufacturing, low cost, and chemical stability toward typical cleaning, sanitizing and disinfecting compositions. The preferred materials are rigid synthetic polymers. The most preferred synthetic polymers for this purpose are polyesters or polypropylene. Most preferably, the retainer is dimensioned to fit diptubes with a specific diameter, but not necessarily generic diptubes. In this case, the retainer can be optionally manufactured as an integral part of the diptube or fused with the lower end of the diptube.

The sleeve is applied on to the diptube as earlier described.

Of course, other modes for mounting the recharge sleeve on the diptube of a standard spray dispenser can be used, such as those discussed in U.S. Pat. No. 6,250,511.

The invention thus provides a dry-to-the-touch recharge sleeve for allowing convenient re-use of a spray dispenser bottle. The recharge sleeve and the retainer are preferably provided together as an entirely self-contained unit which does not require any modification to standard spray dispenser devices for its use. Most preferably, the retainer is dimensioned to fit diptubes of specific outside diameters, but not necessarily only generic diptubes. The retainer is preferably attached to the lower end of the diptube before the application of the sleeve, for example, during manufacture of the diptube. Optionally, the retainer can be provided as an integral part of the diptube or fused together using known methods. The dry-to-the-touch recharge sleeve eliminates the need to ship, stock, and stack refill bottles for each type and grade of cleaning fluid of the original product. They are a fraction of the weight and volume of refills in solution, and can be manufactured at low cost. It can also be installed easily, without potential hazards to the user due to spillage, or puncturing or bursting of cartridges.

The recharge sleeves have been described herein for use with a spray dispenser device for delivering cleaning, sanitizing and the like solutions. The recharge sleeves can additionally be used to deliver flavorants, medicinals or nutriceuticals by impregnating the sleeve matrix material with a composition which when the sleeve is introduced into a delivery bottle or container such as conventionally used for water, juice or the like provided with a cap having attached on its inner aspect a diptube by placement of the sleeve over the diptube, on contact with the water or other fluid in the bottle or container the impregnated flavorant, nutriceuticals, etc., will be dissolved in the water or other fluid. When the container is emptied all that is necessary is to remove the recharge sleeve and replace it with another.

An early appreciated advantage of this aspect of the invention is that it is no longer necessary to ship or carry filled bottles, or to refrigerate filled bottles. The bottle once emptied can have a new recharge sleeve inserted at the point or time of use.

Another advantage lies in the economics; a packet of sleeve inserts can be purchased without having to repurchase a bottle or container for each use.

It is to be understood that many modifications and variations may be devised given the above description of the principles of the invention. It is intended that all such modifications and variations be considered as within the spirit and scope of this invention, as defined in the following claims.

What is claimed is:

1. A hollow retainer for retaining a recharge sleeve for use with a spray dispenser device having a container body, spray head removably attached with a sealing cap to the container body and an elongated diptube comprising an upper end and a bottom end, the upper end of the diptube being inserted into and extending into the container body during use, the recharge sleeve comprising a material impregnated with a chemical composition so that the recharge sleeve does not make direct skin contact, the chemical composition being capable of being dissolved in solution with a diluent fluid can penetrate into the material and dissolve the chemical composition therein for forming solution thereof in the fluid, the recharge sleeve being adapted for removal when spent and being replaced with another impregnated recharge sleeve, the material comprising at least one rectangular-shaped layer bonded along its elongated edges so as to form an opening in a center thereof parallel to the elongated edges for mounting on the diptube, the hollow retainer being conical in shape and comprising an upper end, a lower end, and a square-cut shoulder at the upper end, the hollow retainer being adapted and dimensioned to be attached to the bottom end of the diptube and the square-cut shoulder of the hollow retainer retaining the recharge sleeve onto the diptube clear of the lower end of the hollow retainer said hollow retainer further comprising multiple ridges on its outside surface protruding outwardly radially for retaining the recharge sleeve clear of the lower end of the said hollow retainer.

2. The hollow retainer of claim 1 further comprising at least one opening at the lower end of the hollow retainer for allowing the solution to flow into the diptube.

3. The hollow retainer of claim 1 further comprising an inside diameter at an opening in the upper end of the hollow retainer and an inside diameter at an opening in the lower end of the hollow retainer, wherein the inside diameter at the lower end being smaller than the inside diameter at the upper end, wherein the upper end opening inside diameter is dimensioned so that the retainer can fit tightly on the diptube, wherein the lower end opening inside diameter is dimensioned to prevent the diptube from protruding through the lower end of the retainer.

4. The hollow retainer of claim 3 further comprises a void defined by the upper end opening and the lower end opening, wherein a diameter of the void tapers from the upper end inside diameter to the lower end inside diameter.

5. The hollow retainer of claim 1, wherein the hollow retainer is made of a synthetic polymer.

6. The hollow retainer of claim 1, wherein the hollow retainer is made of rigid plastic.

7. The hollow retainer of claim 5, wherein the polymer is selected from a group of polyester and polypropylene.

* * * * *